US005355116A

United States Patent [19]

Applegate et al.

[11] Patent Number: 5,355,116

[45] Date of Patent: Oct. 11, 1994

[54] ADJUSTABLE STROBE WITH TEMPERATURE STABILIZATION

[75] Inventors: Ed Applegate, Toms River; Joseph Kosich, South Toms River; John W. Curran, Lebanon, all of N.J.

[73] Assignee: Wheelock, Long Branch, N.J.

[21] Appl. No.: 31,947

[22] Filed: Mar. 16, 1993

[51] Int. Cl.[5] ..... G08B 5/00

[52] U.S. Cl. ..... 340/331; 340/332; 340/326; 315/200 A; 315/127

[58] Field of Search ..... 340/331, 332, 326, 815.11; 315/200 A, 241 S, 241 D, 24 R, 307, 127; 307/25; 363/15, 19, 90, 91, 50, 78, 124, 131

[56] References Cited

U.S. PATENT DOCUMENTS

| | | | |
|---|---|---|---|
| 3,634,840 | 1/1972 | Wilkinson | 340/331 |
| 3,683,347 | 8/1972 | Melone | 340/331 |
| 3,761,921 | 9/1973 | Adler | 340/331 |
| 3,765,006 | 10/1973 | Takahashi et al. | 340/331 |
| 3,772,564 | 11/1973 | Leskin . | |
| 3,819,983 | 6/1974 | Bjork . | |
| 4,068,149 | 1/1978 | Wuchinich | 340/331 |
| 4,101,880 | 7/1978 | Haus | 340/331 |
| 4,243,917 | 1/1981 | Caprari . | |
| 4,287,509 | 9/1981 | Beggs | 340/326 |
| 4,404,498 | 9/1983 | Spiteri . | |
| 4,692,668 | 9/1987 | Brown . | |
| 4,967,177 | 10/1990 | Nguyen . | |
| 5,111,116 | 5/1992 | Takeda . | |
| 5,121,033 | 6/1992 | Kosich . | |
| 5,162,702 | 11/1992 | Schmees et al. . | |
| 5,189,344 | 2/1993 | Rose . | |

OTHER PUBLICATIONS

Wheelock Schematic 24 DC High Power Strobe, No. S80611-004 & 006, May 8, 1984 (marked Obsolete Aug. 1, 1990).

*Primary Examiner*—John K. Peng
*Assistant Examiner*—Nina Tong
*Attorney, Agent, or Firm*—Brumbaugh, Graves, Donohue & Raymond

[57] ABSTRACT

A strobe alarm circuit includes a voltage source circuit which has a capacitor connected across its output terminals. The voltage source circuit is connected to a flash circuit which includes a flashtube shunted by a trigger circuit. The trigger circuit causes the flashtube to flash when the voltage across the voltage source circuit capacitor reaches a predetermined threshold firing voltage. A resistor divider network is employed in the trigger circuit to ensure that the flashtube is triggered at virtually the same instant as the voltage across the capacitor exceeds the trigger threshold value.

3 Claims, 1 Drawing Sheet

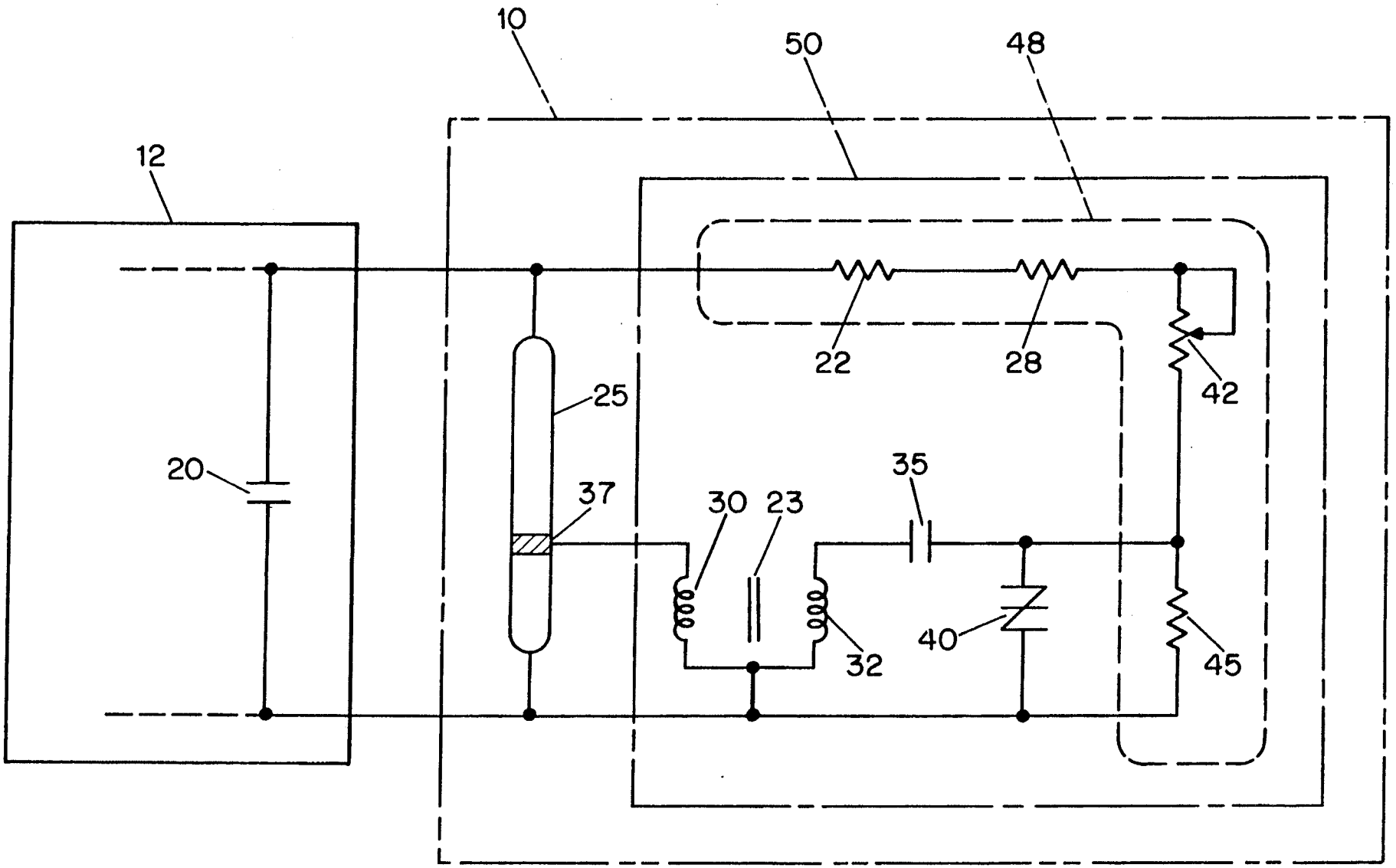
42
45
48
28
40
35
32
50
22
23
30
25
37
10
20
12

ADJUSTABLE STROBE WITH TEMPERATURE STABILIZATION

BACKGROUND OF THE INVENTION

This invention relates generally to electronic strobe light circuits and more particularly to the flash trigger circuit of an electronic strobe light in an emergency warning system. Such strobe light devices are frequently associated with audible warning devices such as horns, and provide an additional means for getting the attention of persons who may be in danger. Proper operation of the strobe light is of the utmost importance to persons in danger who are hard of hearing or deaf.

In a typical strobe light circuit of this type, the strobe light is a gaseous discharge tube, the firing of which is initiated by a trigger circuit. The flash circuit, which includes the flashtube and the trigger circuit, is typically energized from a voltage source circuit having a capacitor across its output terminals which is connected in parallel with the flash circuit. The flash occurs when the voltage across the tube exceeds the threshold firing voltage required to actuate the trigger circuit. When the flashtube is triggered, it becomes conductive and rapidly discharges the stored energy from the voltage source circuit capacitor until the voltage across the flashtube has decreased to a value at which the flashtube extinguishes and becomes nonconductive.

In one known strobe circuit of the type described above, the trigger circuit uses a SIDAC which breaks down at a predetermined voltage causing the flashtube to trigger. The relationship between the voltage across the voltage source circuit capacitor and the voltage across the SIDAC is important to the operation of the flash circuit. Ideally, the SIDAC breaks down at precisely the time when the voltage source circuit capacitor is charged with enough energy to cause the flash tube to flash with a desired light output. The voltage across the capacitor at this time is the threshold firing voltage. If the SIDAC breaks down at a later time, the capacitor will have charged beyond the energy level which the flashtube was intended to dissipate, thus causing unnecessary wear on the flashtube, as well as the voltage source circuit capacitor. Conversely, if the SIDAC breaks down before the capacitor has fully charged, the flash will be weak, an unacceptable result in a system which is designed to save lives.

The trigger circuit of the prior art provides only a single resistor to govern the relationship between the capacitor voltage and the SIDAC voltage. In an ideal circuit, the single resistor would be enough to ensure the desired linear relationship between the capacitor and SIDAC voltages. However, variances in the electrical element values, even within stated tolerances, or variances in the values due to temperature changes can cause maloperations as described above.

SUMMARY OF THE INVENTION

It is a primary object of the present invention to provide a flash circuit which consistently flashes at a predetermined intensity.

In the strobe alarm circuit of the present invention, a voltage source circuit includes a capacitor connected across its output terminals. The voltage source circuit is connected to a flash circuit which includes a flashtube shunted by a trigger circuit which causes the flashtube to flash when the voltage across the voltage source circuit capacitor reaches a predetermined threshold firing voltage. A resistor divider network is employed in the trigger circuit to ensure that the flashtube is triggered at virtually the same instant as the voltage across the capacitor exceeds the trigger threshold value. The resistor divider network includes both a potentiometer which can be adjusted at the factory to compensate for electrical element value variations due to stated tolerances and a thermistor to compensate for electrical element value variations due to temperature fluctuations.

BRIEF DESCRIPTION OF THE DRAWING

Other objects, features and advantages of the invention will become apparent and its construction and operation better understood, from the following detailed description, taken in conjunction with the accompanying drawing, the single FIGURE of which is a schematic circuit diagram of the preferred embodiment of the invention.

DETAILED DESCRIPTION OF THE PREFERRED EMBODIMENT

The FIGURE shows a strobe circuit having a voltage source circuit 12 connected to a flash circuit 10. The voltage source circuit 12 typically includes, across its output terminals, an electrolytic capacitor 20 which is charged intermittently until it reaches a predetermined threshold voltage, at which time the trigger circuit 50 triggers the flashtube 25, causing it to become conductive, and the voltage source circuit capacitor 20 discharges its energy into the flashtube 25, thereby causing a flash of a predetermined intensity. Two preferred voltage source circuits are disclosed, in operation with a flash circuit of the prior art as discussed in the Background section hereinabove, in co-assigned U.S. Pat. Nos. 4,967,177 (Nguyen) and 5,121,033 (Kosich). These voltage source circuits, known as DC-to-DC converters, take a low input voltage and charge a capacitor to a much higher voltage. Those skilled in the art will appreciate that many other types of voltage source circuits may be employed in conjunction with the flash circuit of present invention.

Returning now to the FIGURE, the flash circuit 10 has the capacitor 20 of the voltage source circuit 12 connected in parallel to it. Flashtube 25 is shunted by the trigger circuit 50 which includes a resistor divider network 48 connected across the flashtube and to the combination of a semiconductor element, here a SIDAC 40, connected in parallel with the series combination of a capacitor 35 and the primary winding 32 of an autotransformer 23. The secondary winding 30 of the autotransformer 23 is connected to the trigger band 37 of the flashtube 25 so that when the voltage across the flashtube 25 exceeds its threshold firing voltage, the SIDAC 40 will break down and capacitor 35 will discharge through the autotransformer 23, thereby causing the flashtube 25 to become conductive. The flashtube 25 quickly discharges the energy stored in capacitor 20, and the capacitor 20 is then recharged by the voltage source circuit 12.

As discussed in the Background section hereinabove, it is very important to the efficient operation of the flash circuit 10 that the SIDAC 40 breaks down at the time when the voltage source circuit capacitor 20 has charged to the threshold firing voltage. The resistor divider network 48 is designed to ensure that these two events occur virtually simultaneously. The network 48 includes the series connection of resistor 22, thermistor 28, potentiometer 42 and resistor 45 connected in parallel to capacitor 20 and flashtube 25, with SIDAC 40 connected in parallel to resistor 45. It will be appreciated that resistor 22 is not necessary since potentiometer 42 may be of a high resistance, but the addition of resistor 22 allows potentiometer 42 to be of a low enough resistance to allow for a fine adjustment of the resistor divider network 48.

The resistor divider network 48 creates the following relationship between the voltage across capacitor 20 and the voltage across SIDAC 40: $V_{SIDAC}=(R_{45}/(R_{45}+R_{22}+R_{42}+R_{28}))V_{cap}$, where $R_{num}$ is the resistance across the element which is denoted by the subscript number in the FIGURE. If the known breakdown voltage of SIDAC 40 is substituted for $V_{SIDAC}$ and the threshold firing voltage is substituted for $V_{cap}$, the resistance values of the elements in the network 48 can be easily chosen. However, one skilled in the art will certainly appreciate that the actual values of the chosen electrical elements do not always match the stated values. Indeed, the tolerance ratings for electrical elements can typically be ±5% or higher. A 5% difference in the stated breakdown voltage of the SIDAC 40, for example, could cause maloperations of the flash circuit of the type discussed in the Background section of this specification. To compensate for these variances in electrical element values, potentiometer 42 can be adjusted for each circuit at the time of manufacture of the circuit.

The resistor divider network 48 also solves another problem which has been found with the operation of the prior art flash circuit: at low temperatures, the light output of the flashtube decreases. At zero degrees centigrade, for example, the light output of the flashtube of the prior art circuit was found to have dropped off between 25% and 30%. The primary causes were changes in the capacitance of voltage source circuit capacitor 20 and its equivalent series resistance (ESR). Negative temperature coefficient thermistor 28 compensates for these changes by providing an increased resistance as the temperature decreases. This allows the voltage across capacitor 20 to rise to a higher level before SIDAC 40 breaks down, thereby making up the lost light output. The extra time it takes to charge the capacitor 20 to a higher voltage, however, will result in a slight decrease in the flash rate.

While the above is a description of the invention in its preferred embodiment, various modifications, alternate constructions and equivalents may be employed. Therefore, the above description and illustration should not be taken as limiting the scope of the invention which is defined by the appended claims.

I claim:

1. A strobe light circuit for flashing a flashtube at a desired rate and intensity comprising:

a voltage source circuit including a first capacitor which is connected in parallel with the flashtube, the first capacitor providing the energy to fire the flashtube upon attainment across the first capacitor of a voltage corresponding to a predetermined threshold firing voltage; and a flash circuit connected across the voltage source circuit which includes a flashtube and a trigger circuit, the trigger circuit being operable to fire the flashtube to generate a light output upon the first capacitor charging to a voltage corresponding to the threshold firing voltage of the flashtube, the trigger circuit including a circuit means for ensuring that the flashtube is fired at virtually the same instant the voltage across the first capacitor exceeds the threshold firing voltage, the circuit means comprising a series resistor divider network which includes a thermistor for compensating for changes in the values of electrical elements in the strobe light circuit which may occur due to temperature changes, a potentiometer to allow for adjustments in the resistance of the series resistor divider network and a resistor.

2. The strobe light circuit of claim 1 wherein the trigger circuit comprises the series resistor divider network connected across the flashtube, and a semiconductor element connected in parallel with the resistor and with a series combination of a second capacitor and the primary winding of an autotransformer, the second winding of the autotransformer connected to the flashtube so that when the voltage across the flashtube exceeds its threshold firing voltage, the semiconductor element will become conductive and the second capacitor will discharge through the autotransformer causing the flashtube to become conductive.

3. The strobe light circuit of claim 2 wherein the semiconductor element is a SIDAC.

* * * * *

UNITED STATES PATENT AND TRADEMARK OFFICE

CERTIFICATE OF CORRECTION

PATENT NO. : 5,355,116

DATED : October 11, 1994

INVENTOR(S) : Edward Applegate, Joseph Kosich and John W. Curran

It is certified that error appears in the above-indentified patent and that said Letters Patent is hereby corrected as shown below:

Col. 4, line 17, "a flashtube" should read --the flashtube--;
Col. 4, line 38, "second" should read --secondary--.

Signed and Sealed this

Fourteenth Day of February, 1995

*Attest:*

Bruce Lehman

BRUCE LEHMAN

*Attesting Officer*

*Commissioner of Patents and Trademarks*